US009087496B2

(12) United States Patent
Eventoff et al.

(10) Patent No.: US 9,087,496 B2
(45) Date of Patent: Jul. 21, 2015

(54) HYBRID DRUM

(71) Applicant: MIDItroniX, LLC, Bow, WA (US)

(72) Inventors: Franklin N. Eventoff, Bow, WA (US); Mario J. Deciutiis, Bow, WA (US)

(73) Assignee: MIDItroniX, LLC, Bow, WA (US)

( * ) Notice: Subject to any disclaimer, the term of this patent is extended or adjusted under 35 U.S.C. 154(b) by 251 days.

(21) Appl. No.: 13/742,240

(22) Filed: Jan. 15, 2013

(65) Prior Publication Data

US 2013/0125729 A1 May 23, 2013

Related U.S. Application Data

(63) Continuation of application No. 12/910,524, filed on Oct. 22, 2010, now Pat. No. 8,354,581.

(51) Int. Cl.
*G10D 13/08* (2006.01)
*G10D 13/02* (2006.01)

(52) U.S. Cl.
CPC ..... *G10D 13/02* (2013.01); *G10D 13/024* (2013.01); *G10D 13/027* (2013.01)

(58) Field of Classification Search
CPC ... G10H 2220/525; G10H 1/00; G10H 3/146; G10H 2230/275; G10H 3/12; G10H 2230/291; G10H 2230/301; G10H 2230/305; G10D 13/024; G10D 13/021; G10D 13/023; G10D 13/027; G10D 13/02; G10D 13/00; G10D 13/028; G01H 13/00
See application file for complete search history.

(56) References Cited

U.S. PATENT DOCUMENTS

| | | | | |
|---|---|---|---|---|
| 5,293,000 | A * | 3/1994 | Adinolfi | 84/730 |
| 5,811,709 | A * | 9/1998 | Adinolfi | 84/723 |
| 5,977,473 | A * | 11/1999 | Adinolfi | 84/723 |
| 8,354,851 | B2 * | 1/2013 | Schlechtriemen et al. | 324/686 |
| 2002/0184992 | A1 * | 12/2002 | Brando | 84/411 R |
| 2003/0061932 | A1 * | 4/2003 | Tanaka et al. | 84/734 |
| 2006/0021495 | A1 * | 2/2006 | Freitas | 84/723 |
| 2012/0097009 | A1 * | 4/2012 | Eventoff et al. | 84/413 |

* cited by examiner

*Primary Examiner* — Marlon Fletcher
(74) *Attorney, Agent, or Firm* — K. David Crockett, Esq.; Paul J. Backofen, Esq.; Crockett & Crockett, PC

(57) ABSTRACT

A hybrid drum as described combines the characteristics of both acoustic and electronic percussion apparatus enabling a musician to have a single instrument and have either acoustic or electronic output. A hybrid drum includes a multilayer drum head with a built-in FSR sensor such that the FSR drum head replaces the drum head of the acoustic drum and can be used to perform acoustically and or electronically. The FSR sensor is built into a double layer, double-head acoustic drum head, wherein one layer of the double head system has the FSR element printed on it, while the other layer of the double layer head has the inter-digiting conductive fingers printed on it and facing the FSR element. A conductive tail extends from one of the drum head layers and is operably connected to an electronic module secured to the drum shell.

3 Claims, 4 Drawing Sheets

HYBRID DRUM

RELATED APPLICATIONS

This application is a continuation of U.S. Utility patent application Ser. No. 12/910,524 filed Oct. 22, 2010, now U.S. Pat. No. 8,354,581.

FIELD OF THE INVENTIONS

The inventions described below relate to the field of percussion musical instruments, specifically that of hybrid acoustic and electronic drums.

BACKGROUND OF THE INVENTIONS

Acoustic drums have existed for thousands of years. Modern materials have created drums with improved characteristics and sound over their ancient predecessors.

Electronic percussion instruments have been known since the late 1970's. They offer a wider range of potential sound variety than acoustic drums, as well as the possibility of quiet operation in situations where the high sound level of acoustic percussion is undesirable.

Acoustic drums have different playing characteristics than their electronic counterparts requiring a musician to translate their style from an acoustic drum to its corresponding electronic instrument.

SUMMARY

A hybrid drum as described below combines the characteristics of both acoustic and electronic percussion apparatus enabling a musician to have a single instrument and have either acoustic or electronic output. A hybrid drum includes a multilayer drum head with a built-in force sensing resistor (FSR) sensor such that the FSR drum head replaces the drum head of the acoustic drum and can be used to perform acoustically and or electronically. The FSR sensor is built into a double layer, double-head acoustic drum head, wherein one layer of the double head system has the FSR element printed on it, while the other layer of the double layer head has the inter-digiting conductive fingers printed on it and facing the FSR element. A conductive tail extends from one of the drum head layers and is operably connected to an electronic module secured to the drum shell.

A hybrid drum includes a drum shell and a multilayer drum head having at least a first layer and a second layer, the drum head is secured to the drum shell by a rim using a plurality of tension rods with the first layer secured to the second layer and the second layer secured against the drum shell, enclosing the drum shell. The first layer of the multilayer drum head has an upper surface and a contact surface, the upper surface for contacting the implements for generating the musical sounds such as drumsticks, mallets, fingers and hands. The contact surface of the first layer including a deposited layer of electrically conductive material forming a portion of a force sensing resistor. The second layer has a lower surface and a contact surface and a contact tail. The contact surface engages the contact surface of the first layer and completes the force sensing resistor, the force sensing resistor thus formed is operably connected to the contact tail. The second layer lower surface engages the drum shell and at least partially encloses the drum shell. An electronics module is secured to the drum shell and is operably connected to the FSR sensor or sensors through the contact tail.

DETAILED DESCRIPTION OF THE INVENTIONS

Figure 1:
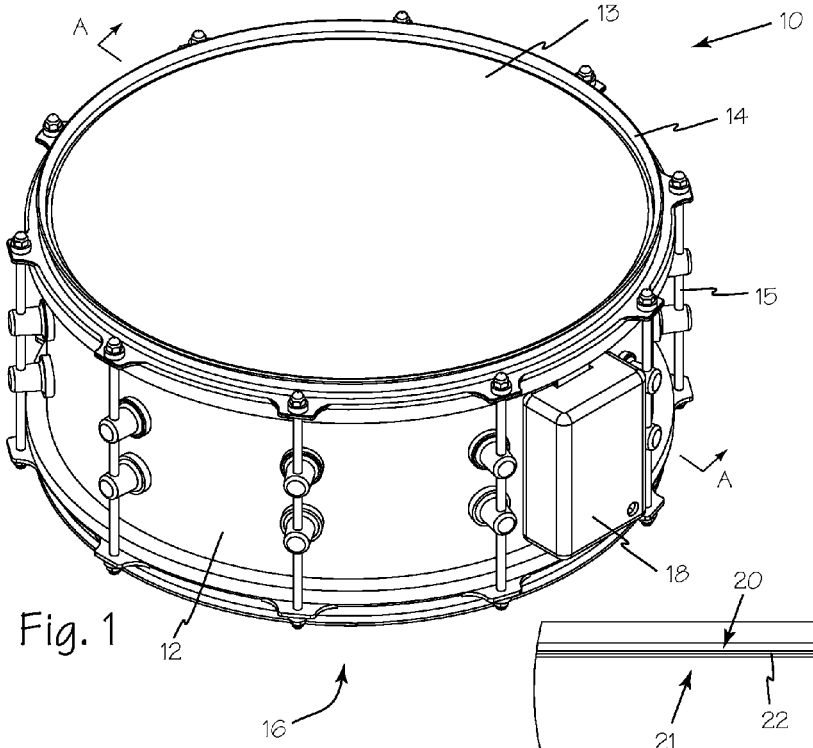
FIG. 1 is a perspective view of a hybrid drum.

Hybrid drum 1 of FIG. 1 includes drum body or shell 3 and at least one drumhead 4 which is secured to shell 3 by tension ring or hoop 5. Hoop 5 is secure to shell 3 by a plurality of tension rods 6 which permit adjustment and tuning of hybrid drum 1. A second or resonator head 7 may also be included. Electronics module 9 is secured to shell 3.

Force sensing resistor sensors (FSRs) are comprised of a thick-film semiconducting material deposited on a non-conductive substrate. The material exhibits changes in its electrical conductivity, proportional to the amount of force (pressure) applied to it. Typically, electrical contact is made to the FSR material by means of conductive traces printed above or below the FSR layer and/or on a second substrate, the FSR and trace surfaces positioned facing each other and in intimate contact. Unlike piezo material, FSRs can respond to constant steady-state pressure, since they are electrically resistive as opposed to capacitive. A wide variety of FSR sensor functionality is possible depending on the geometries of the elements. As FSRs are resistive instead of capacitive, they offer virtual immunity to crosstalk. Positional information is easily derived from FSR-based sensors, either by placing multiple FSR areas within the striking surface (usually on a common substrate) or by configuring the conductive traces such that a "potentiometer" topology is created, allowing sensing of both pressure and (continuous) position. The latter approach, while providing continuous position information, requires switching of the circuit topology between force and position measurement configurations, and this will add complexity.

Figure 3:
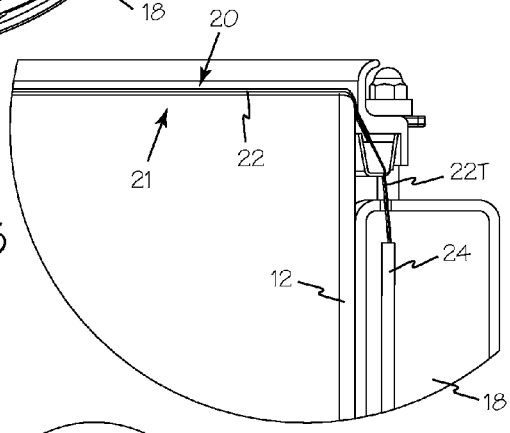
FIG. 3 is a close-up view of the connector feed-through of the rim taken along B-B.
Figure 2:
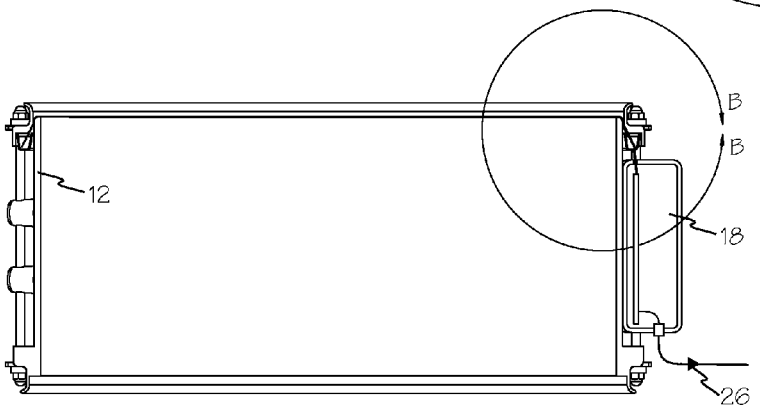
FIG. 2 is a cross-section view of the hybrid drum of FIG. 1 taken along A-A.

Referring now to FIGS. 2 and 3, shell 3 provides structural support for multilayer drumhead 4. Drumhead 4 has a first or upper layer 11 and a second or lower layer 12 with FSR sensor 13 formed between first and second layers 11 and 12. Electrical connections to sensor 13 are formed through connector tail 13T which connects with one or more electronic components such as circuit board 15 in electronics module 9.

Figure 4:
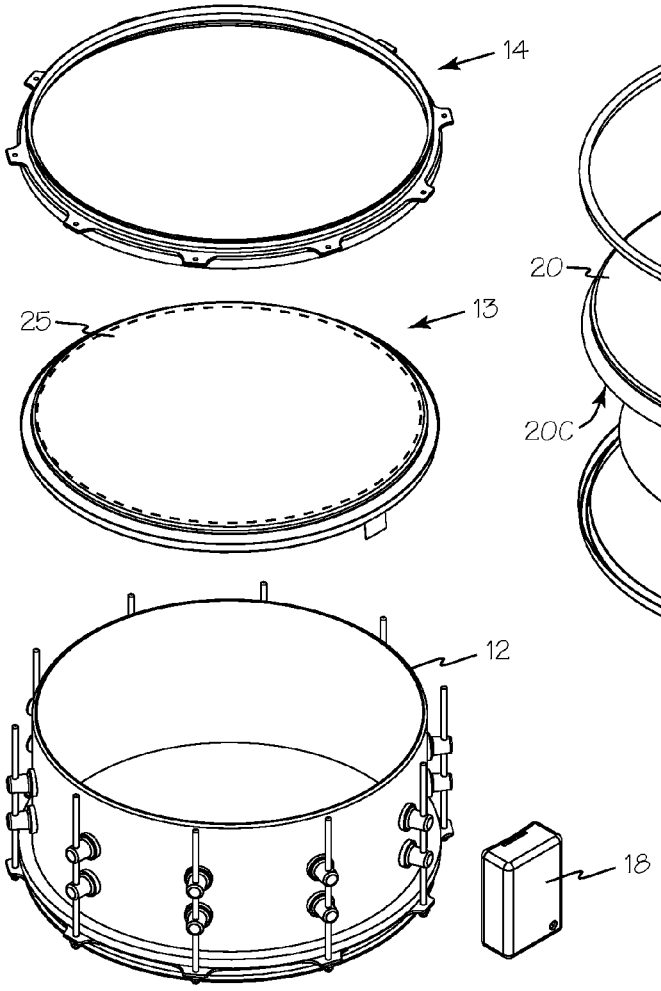
FIG. 4 is an exploded view of the hybrid drum of FIG. 1.
Figure 5:
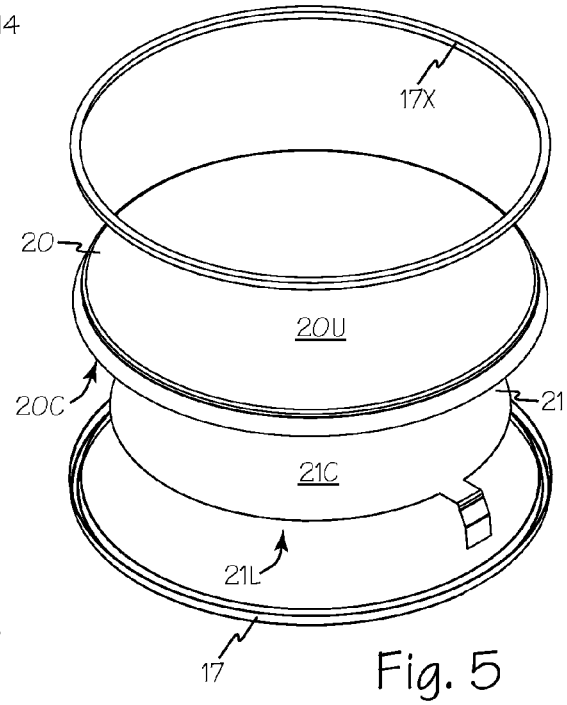
FIG. 5 is an exploded view of the drumhead assembly of FIG. 4.

Referring now to FIGS. 4 and 5, multilayer drumhead 4 is separated from hoop 5 and from head frame 8. Drumhead 4 is separated into first layer 11 which has an upper surface 11U and an opposing lower surface called contact surface 11C. The dimensions and placement of contact surface 11C define playing zone 16 which is the area covered by one or more force sensing resistor sensors such as sensor 13. Second layer 12 has a lower surface 12L and an opposing upper surface called contact surface 12C. First layer 11 is superimposed over second layer 12 and is oriented with first layer contact surface 11C facing second layer contact surface 12C. With drumhead 4 formed with this orientation, hybrid drum 1 with hybrid drumhead 4 may be played by a musician as an acoustic drum by striking upper surface 11U of first layer 11 within playing zone 16. When connected and used in electronic mode, the pressure against upper surface 11U forces contact surface 11C to touch contact surface 12C completing the sensor circuit and generating a musical signal 17.

Figure 6:
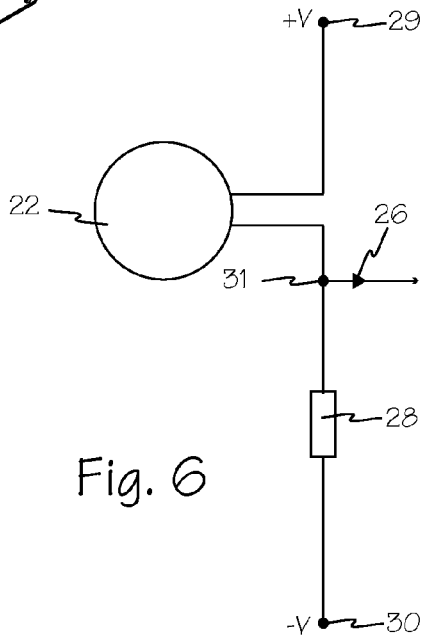
FIG. 6 is a block diagram of an FSR sensor biasing schematic.

Referring now to FIG. 6, FSR sensor 13 must be biased in order to produce a voltage. A simple configuration for sensor biasing is accomplished by connecting sensor 13 in series with a resistor such as resistor 19 and applying a positive voltage 20 to sensor 13 and a negative voltage 21 to resistor 19 in order to get a positive going output voltage or signal 17 at output junction 22.

For some systems this might be enough, but frequently some form of processing is required since the biased sensor alone is a high impedance and unable to drive a more common lower impedance input or one expecting a higher voltage excursion. Initial processing may be provided on circuit board 15 or on some other suitable component of electronic module 9. The simplest of these is an amplifier with a high impedance input, such as a field effect transistor (FET) or an op-amp based amplifier. Both provide the required high impedance input and voltage gain. This can be enough to feed signal 17 into a drum sound module, for example, that are often designed for a piezo electric sensing device.

For systems that are able to detect the various features of a pulse (for instance, rate of rise, height, width), a simple amplifier is not always suitable since the amplified pulse profile follows that of the sensor. Since the sensor may not produce pulses that are expected by the module input circuit, a pulse shaper is needed. Rather than using a traditional pulse shaping circuit, the sensor voltage pulse may be directed into a digital system that is able to sense the pulse. From the various features of the sensor pulse, it is able to synthesize a parameterized output pulse to match the expected pulse.

Figure 9:
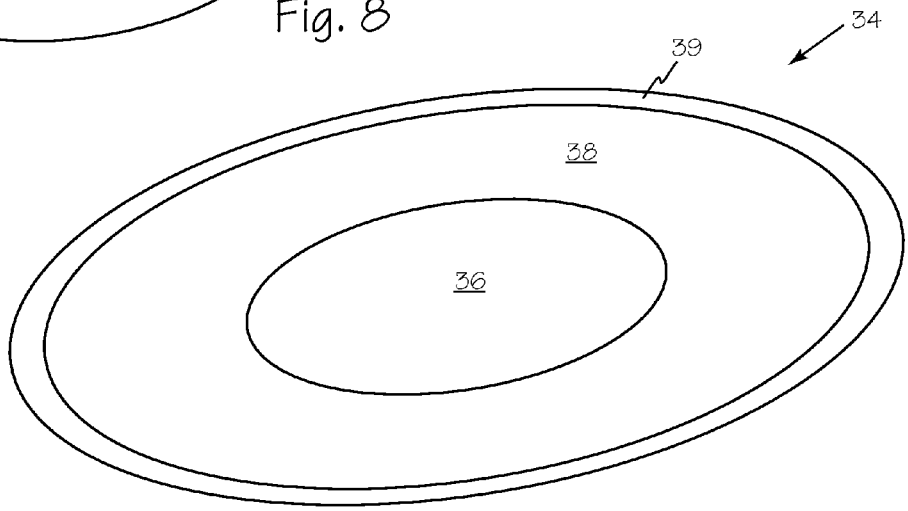
FIG. 9 is a perspective view of an interdigiting layer with multiple zones.

Further, many physical sensors are implemented with a number of distinct regions, each providing a pulse. The above digital system can be extended to provide multiple input and outputs to match the distinct regions. Referring now to FIG. 9, FSR resistor layer 25 includes several distinct drumhead regions are identified for example, center zone 27, main zone 29 and rim zone 30.

Thus, for a number of different configurations, an FSR based drum head can produce pulses to satisfy the input characteristics expected from other sensors but with the advantages of the FSR.

Figure 7:
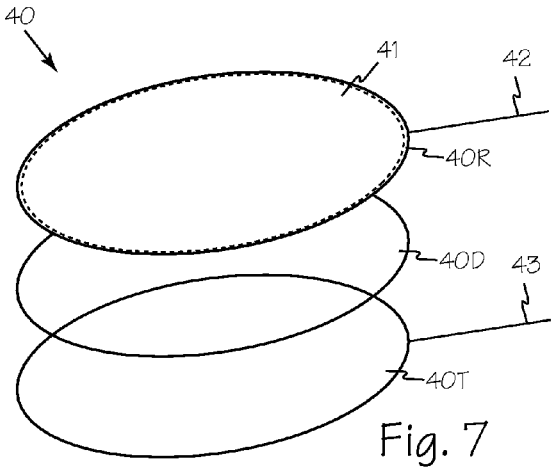
FIG. 7 is a perspective view of the FSR sensor layers for a thru-mode configuration.
Figure 8:
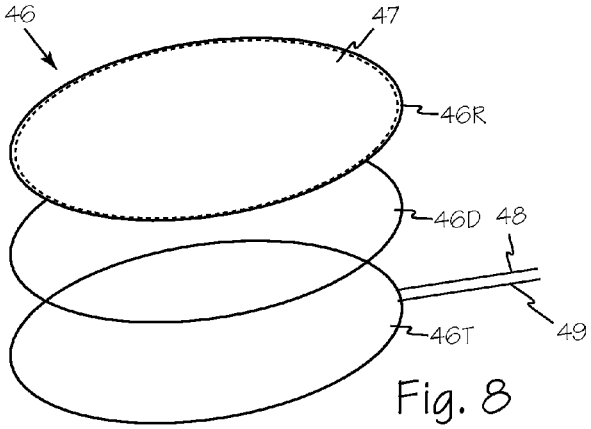
FIG. 8 is a perspective view of the FSR sensor layers for a shunt mode configuration.

Referring now to FIGS. 7 and 8, a hybrid drum may include FSR sensors configured to operate in a shunt-mode or thru-mode sensor configuration. With a thru-mode sensor configuration as illustrated in FIG. 7, a hybrid drumhead equipped with thru-mode sensor 31 can detect a strike anywhere in playing zone 32. Thru-mode sensor 31 is composed of FSR or resistor layer 31R, dielectric layer 31D and trace layer 31T. The electrical circuit is completed through resistor lead 33 and trace lead 34. This can be designed as a single-entry or multi-entry system that can detect one or multiple strikes at a time. Where the FSR sensor is configured as a single linear pot, the sounds might be programmed so that the multiple hits sound the same voice. A linear pot configuration can detect multiple strikes with one linear pot, or multiple linear pots can be designed for programming multiple voices played simultaneously. The linear-pot design may also incorporate a discrete "rim zone" sensor, which is intended to simulate an acoustic drum "rim-shot," can change the strike on the body of the head with additional dynamics when the rim-zone is simultaneously or otherwise struck.

With a shunt mode sensor configuration as illustrated in FIG. 8, a hybrid drumhead equipped with shunt mode sensor 37 can detect a strike anywhere in playing zone 38. Shunt mode sensor 37 is composed of FSR or resistor layer 37R, dielectric layer 37D and trace layer 37T. The electrical circuit is completed through first trace lead 39 and second trace lead 40.

Figure 10:
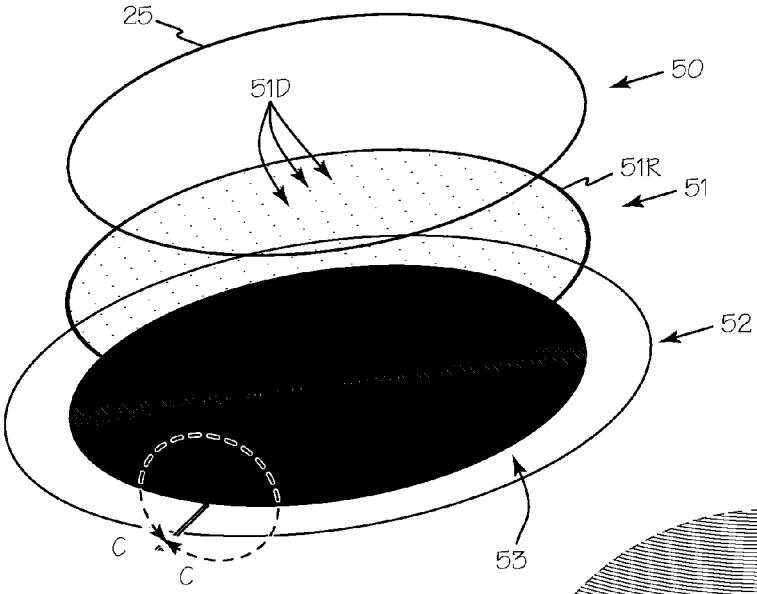
FIG. 10 is a perspective view of the FSR sensor layers deposited on the multilayer drumhead of FIG. 1.

Referring now to FIG. 10, the layers of FSR 13 are separated for clarity. First layer 11 of drumhead 4 has an upper surface 11U and an opposing lower surface called contact surface 11C. Contact surface 11C includes resistor layer 41 deposited to define playing zone 16. Playing zone 16 may include one or more resistor zones as discussed above. Dielectric layer 42 is a planar arrangement of non-conductive elements such as spacer ring 42R and a plurality of separating elements such as dots 42D. The separating elements may adopt any suitable size and shape. Spacer ring 42R and dots 42D may be deposited on resistor layer 41 or trace layer 43. Second layer 12 has a lower surface 12L and an opposing upper surface called contact surface 12C. Second layer contact surface 12C includes one or more sets of interdigiting fingers or trace elements such as fingers 44 deposited to form one or more sensing zones corresponding to resistor zones as described above. Interdigiting fingers 44 may adopt several configurations such as spiral or concentric layouts.

Figure 11:
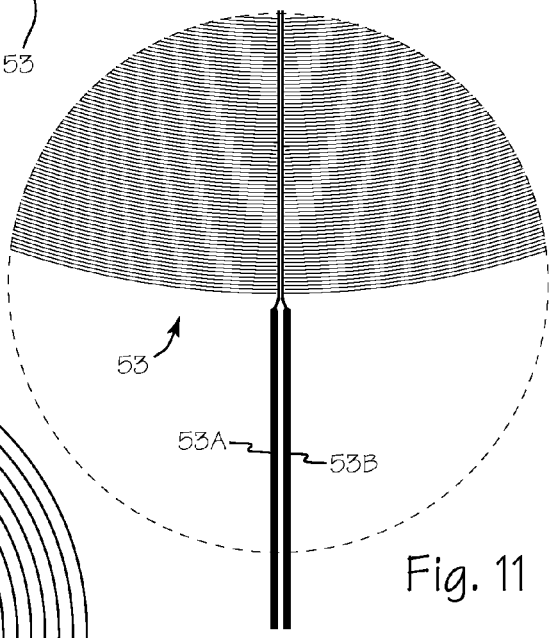
FIG. 11 is a closeup view of the edge of the concentric interdigiting layer and tail traces of the FSR sensor of FIG. 10 taken along C-C.
Figure 12:
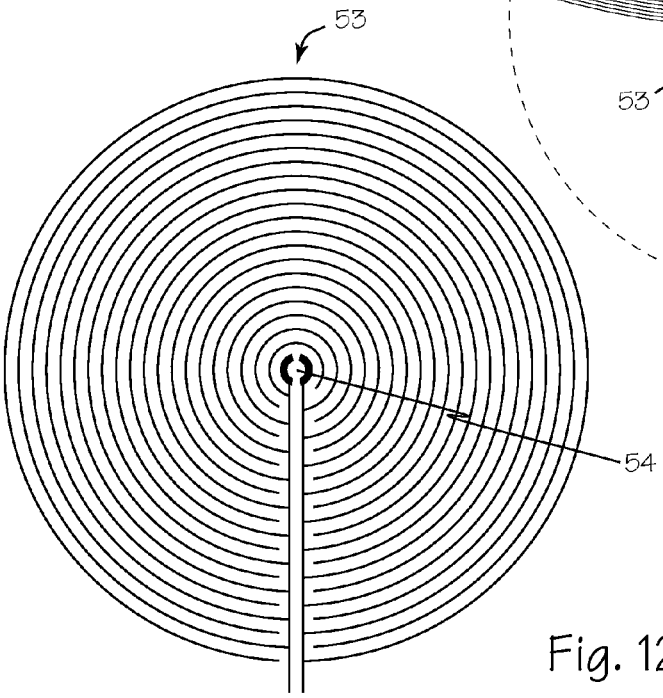
FIG. 12 is a closeup view of the center of the concentric interdigiting layer of FIG. 10.

Referring now to FIGS. 11 and 12, interdigiting fingers 44 are illustrated in a concentric configuration with connector traces 44A and 44B, and in center 45. If the spiral design is used, the firmware can detect position anywhere on the head within the spiral. This also is a single entry device detecting one strike at a time. The spiral design can also be designed with a discrete "rim zone" sensor to change the strike on the body of the head with additional dynamics when the rim-zone is simultaneously or otherwise struck.

In use, first layer 11 is superimposed over second layer 12 and is oriented with first layer contact surface 11C facing second layer contact surface 12C. With drumhead 4 formed with this orientation, hybrid drum 1 with hybrid drumhead 4 may be played by a musician as an acoustic drum by striking upper surface 11U of first layer 11 within playing zone 16.

It may also be necessary to vary the physical and or electrical parameters of the interdigiting fingers of the trace layer to accommodate different drumhead tensions encountered across the surface of an acoustic drumhead. For example, center zone 27 will have less tension than rim zone 30 leading to potentially unmeasurable hits if both zones have the same trace dimensions. It may be necessary to change trace dimensions, or another suitable parameter, over different areas of a drumhead to provide accurate and unambiguous sensing of the hits to the drumhead. In addition the physical and electrical parameters of the FSR layer such as thickness and or resistance profile may also be varied to provide different performance parameters. The physical and electrical parameters of a linear pot configuration may be varied to provide different performance parameters.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A hybrid musical instrument comprising:

an instrument shell;

a multilayer instrument head comprising:

a first layer having an upper surface for engaging implements generating the musical sounds, and a contact surface including a deposited layer of electrically conductive material forming a portion of a force sensing resistor;

a second layer having a contact surface for engaging the contact surface of the first layer and completing the force sensing resistor, the force sensing resistor thus formed is operably connected to a contact tail, the second layer also having a lower surface which engages the instrument shell and at least partially encloses the instrument shell;

wherein the first layer secured to the second layer and the second layer secured against the instrument shell, enclosing the instrument shell;

a rim sized to engage the instrument shell and secure the multilayer instrument head to the instrument shell;

a plurality of tension rods for adjustably securing the rim to the instrument shell; and an electronics module secured to the instrument shell and operably connected to the force sensing resistor through the contact tail.

2. The hybrid musical instrument of claim 1 wherein the contact surface of the second layer comprises:

a plurality of traces deposited on the contact surface, the plurality of trace connected to a connector strip through the contact tail.

3. The musical instrument of claim 1 wherein the contact surface of the first layer comprises:

a layer of conductive material deposited on the contact surface;

a plurality non-conductive spacing elements deposited on the conductive material; and a ring of non-conductive material deposited on the contact surface on the perimeter of the play zone of the head.

* * * * *